US006279170B1

(12) United States Patent
Chu

(10) Patent No.: US 6,279,170 B1
(45) Date of Patent: Aug. 28, 2001

(54) ACTIVE LABELS FOR GARMENTS

(76) Inventor: Victor Chu, 211 W. 53rd St., #4C, New York, NY (US) 10019

( * ) Notice: Subject to any disclaimer, the term of this patent is extended or adjusted under 35 U.S.C. 154(b) by 0 days.

(21) Appl. No.: 08/770,712

(22) Filed: Dec. 19, 1996

(51) Int. Cl.[7] ..... A41D 27/08
(52) U.S. Cl. ..... 2/246
(58) Field of Search ..... 40/661.04, 661.02, 40/1.5, 448, 546, 716, 124.02, 442; 2/246, 244, 905; 362/103

(56) References Cited

U.S. PATENT DOCUMENTS 3,802,945 * 4/1974 James ..... 40/448 X
4,231,034 * 10/1980 Bechteler ..... 40/448 X
4,556,932 * 12/1985 Lehrer et al. ..... 40/661.02 X
4,602,191 * 7/1986 Davila ..... 315/76
4,627,148 * 12/1986 Barlow ..... 40/1.5
4,709,307 * 11/1987 Branom ..... 362/103
4,926,572 * 5/1990 Holmes ..... 40/448
4,974,122 * 11/1990 Shaw ..... 40/546
4,980,679 * 12/1990 Klaubert ..... 40/1.5 X
5,416,310 * 5/1995 Little ..... 235/462
5,461,188 * 10/1995 Drago et al. ..... 84/600
5,473,337 * 12/1995 Berger ..... 40/1.5 X
5,572,554 * 11/1996 Guritz ..... 362/103
5,912,653 * 6/1999 Fitch ..... 345/87

* cited by examiner

*Primary Examiner*—Danny Worrell
(74) *Attorney, Agent, or Firm*—Coats & Bennett, PLLC

(57) ABSTRACT

A label for a garment including an electronic display such as a liquid crystal display for displaying label information. The label information may include a company name or logo that identifies the source of the garment, product information such as the material content of the garment or care instructions, and manufacturer information. The label information can be contained in multiple screen images which can be stepped through by pressing a button or touch-sensitive area of the display. The display can also be programmed to display a series of related images in sequence to produce an animated logo.

21 Claims, 6 Drawing Sheets

ACTIVE LABELS FOR GARMENTS

FIELD OF THE INVENTION

The present invention relates generally to the field of labels and tags for garments and more particularly to electronic labels for garments.

BACKGROUND OF THE INVENTION

It is typical for the manufacturer of a garment to affix a label to the garment which bears the manufacturers brand name or logo. Labels are also used to describe the material contents of a garment, to give care instructions, or to display manufacturer information such as the manufacturer's RIN number. Because labels are typically small, they can carry only a limited amount of information. Therefore, it is not at all uncommon to find two or more labels affixed to different locations of a single garment. For example, a shirt may carry a brand label which is placed in a visible location, and a neck label to give product information. However, there is a small, finite limit to the number of labels which can be applied to a garment without cluttering the garment.

Another problem with conventional labels for garments is that only static designs and information can be contained in the label. Animated designs and logos are not possible with conventional woven, printed or stamped labels. Also, conventional labels cannot display information which may change over time.

SUMMARY OF THE INVENTION

The present invention is an active label which is characterized by a changeable display. The label includes a thin, flexible LCD panel on which various types of label information can be displayed. The LCD panel is contained in a water-tight encasement made from an elastomeric material which can be affixed to a garment. The preferred method of attachment is by sewing the label to the garment. Alternately, the label can be attached to garments by metal or plastic rivets, VELCRO-type fasteners, bartacks, adhesives, snaps, or any other attachment technique known in the garment manufacturing business.

The label information which is displayed can include a company name and/or logo, material content information, care instructions, manufacturer information, e-mail address, web page address, telephone numbers or other information which the manufacturer wants to include on the label. This information can be included in multiple screen images which can be advanced by pressing a button or touch-sensitive input on the display. Also, information which changes over time can be displayed.

The active label of the present invention obviates the need for placing multiple labels on garments as is the current practice. Moreover, the active label of the present invention can display animated logos or changing information which is not possible with current labels.

DETAILED DESCRIPTION OF THE DRAWINGS

Figure 1:
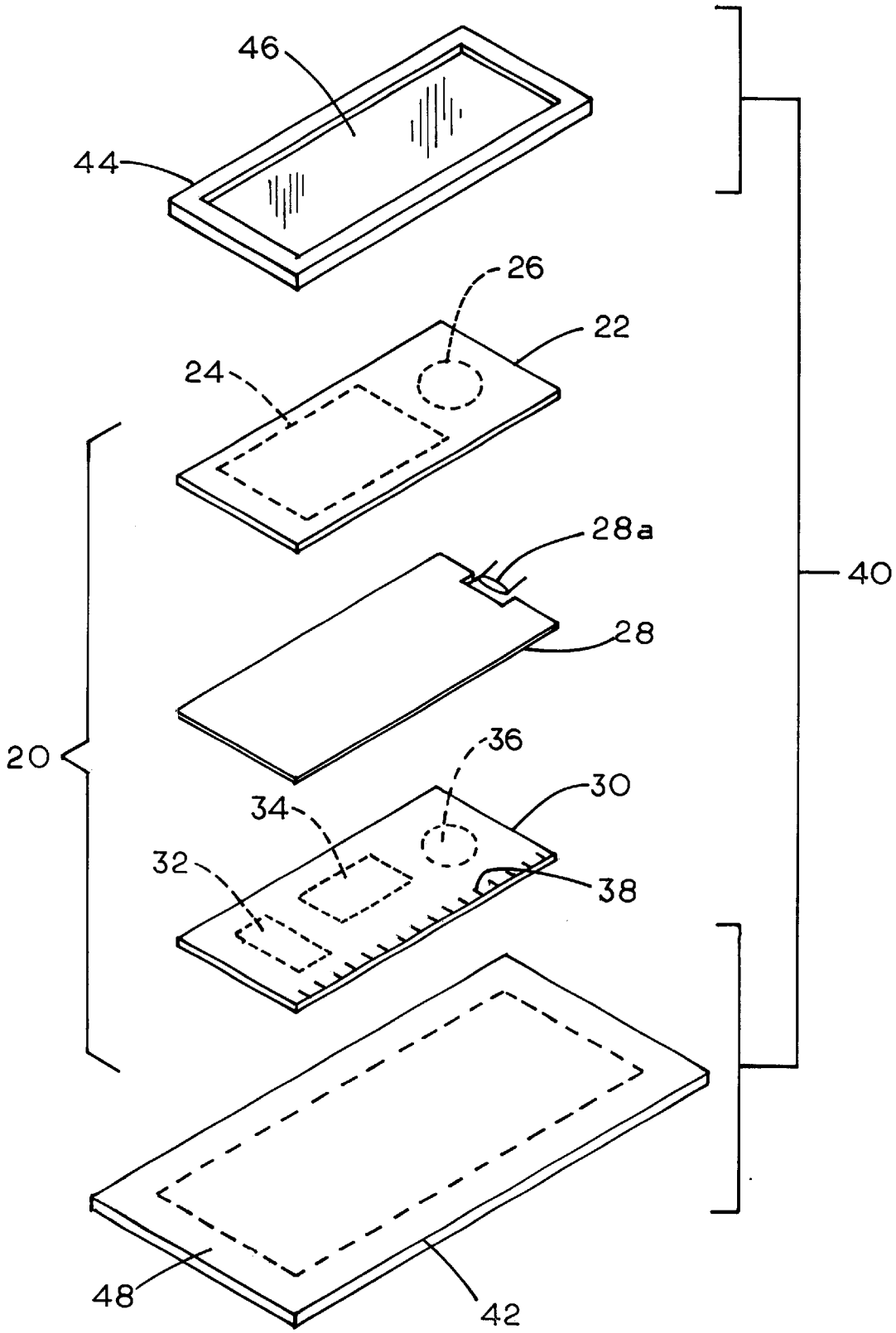
FIG. 1 is an exploded perspective view showing one embodiment of the active label of the present invention.
Figure 2:
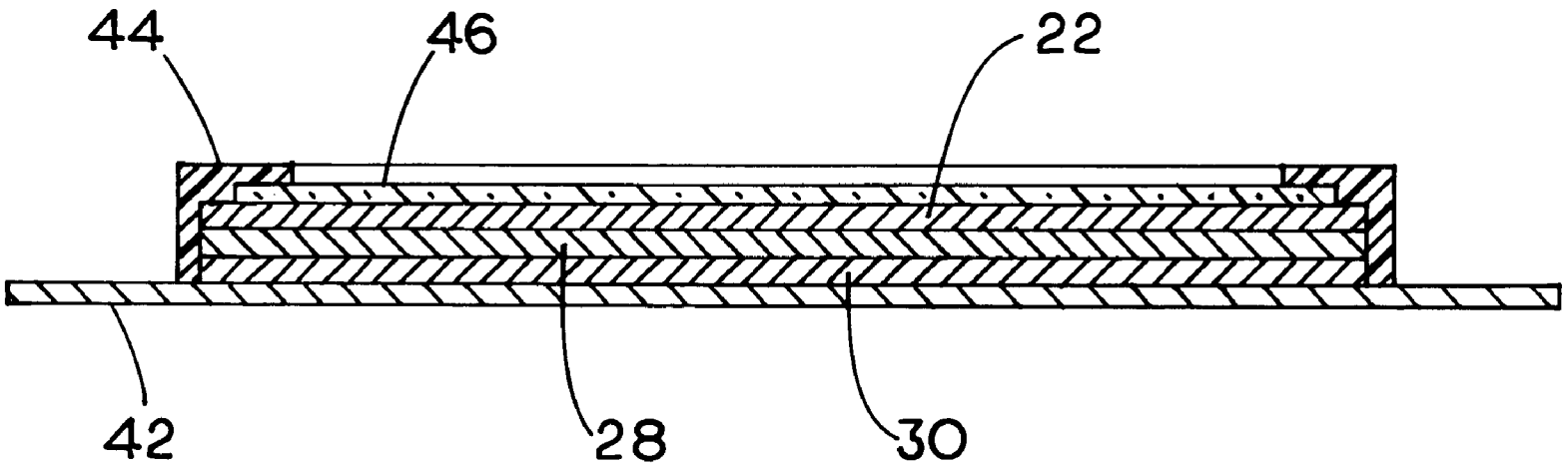
FIG. 2 is a section view of the active label.

Referring now to the drawings, and particularly to FIG. 1, an active label for garments or other clothing articles is shown and indicated generally by the numeral 10. The active label includes an electronic display 20 for displaying label information and a case 40. Preferably, both the electronic display 20 and case 40 are flexible. The label information may consist simply of a brand name or logo which identifies the source or origin of the garment. The label information may also include product information such as the material content of the garment and care instructions or manufacturer information.

The electronic display 20 is preferably a liquid crystal-type display. The display 20 comprises a display panel 22, a backlight panel 28 to backlight the display panel 22, and a circuit board 30 containing an integrated circuit which provides power, data, and control signals for operating the display 20. The display panel 22 is, as already mentioned, a liquid crystal-type display which comprises liquid crystal composites disposed between upper and lower substrates. Display elements are formed by etching a conductive film deposit on the inner surface of each substrate. Etched areas become the display background; unetched areas become the display elements. When a voltage potential is applied, the display elements becomes visible. The display elements can be individually addressed (i.e. their conductive surfaces energized) to selectively activate the display elements. The display panel may be either a monochrome display or a color display. Also, the display panel could be a passive matrix or active matrix display.

Numerous types of LCD panels can be used in connection with the present invention including reflective, transmissive, or transflective panels. However, transflective LCD's are best suited for practicing the present invention because the display elements are visible in a wide variety of lighting conditions including both outdoor and indoor lighting conditions. Transflective displays include a backlighting panel 28 to backlight the display panel 22. Light-emitting diodes (LEDs) 28 provide a light source which is transmitted by the backlight panel 28 which serves as a light guide. An electroluminescent panel could also be used as a backlight for the display panel 22. LED backlighting is preferred, however, because of its longevity. The backlight 28*a* can be manually activated and deactivated by an illumination button 50 (see FIG. 3) on the label 10. Alternatively, the backlight can be activated by a touch-sensitive input (i.e. touch screen) on the display panel 22.

The circuit board 30 contains all of the circuitry necessary to drive the display panel 22. The circuit board contains an integrated circuit which includes a microprocessor 32, display driver 34 and power supply 36. The circuit board 30 includes a series of terminals 38 which are electrically connected to corresponding terminals (not shown) on the display panel 22. Such connection may be made for example by means of a conventional zebra-strip or similar conductive element. In certain cases, it may be necessary to locate the microprocessor 32 and driver circuits 34 remotely from the display panel 22. In these cases, the microprocessor 32 and driver circuit 34 can be connected to the display panel 22 by a conventional flex connector which is disposed between two-layers of the garment. The advantage of locating the circuit components remotely from the display panel 22 lies in the reduction of the size of label 20 making it possible to keep the label 10 thin. The construction of LCD's is well-known to those skilled in the art and therefore will not be described in detail herein.

The case 40 comprises a base panel 42 and a window frame 44 which has a transparent window 46 for viewing the display 20. Both the base panel 42 and window frame 44 are preferably made of an elastomeric material such a flexible, sewable rubber. During assembly, the display 20 is interposed between the base panel 42 and window frame 44. The window frame 44 is then glued or bonded to the base panel 42 to form a water-tight enclosure. The base panel 42 is larger than the window frame 44 so that a peripheral portion 48 of the base panel 42 extends outward from the window frame 44 on all sides. The perimeter portion 48 of the base panel 42 provides a convenient location for stitching to secure the label 10 to a garment.

Figure 3:
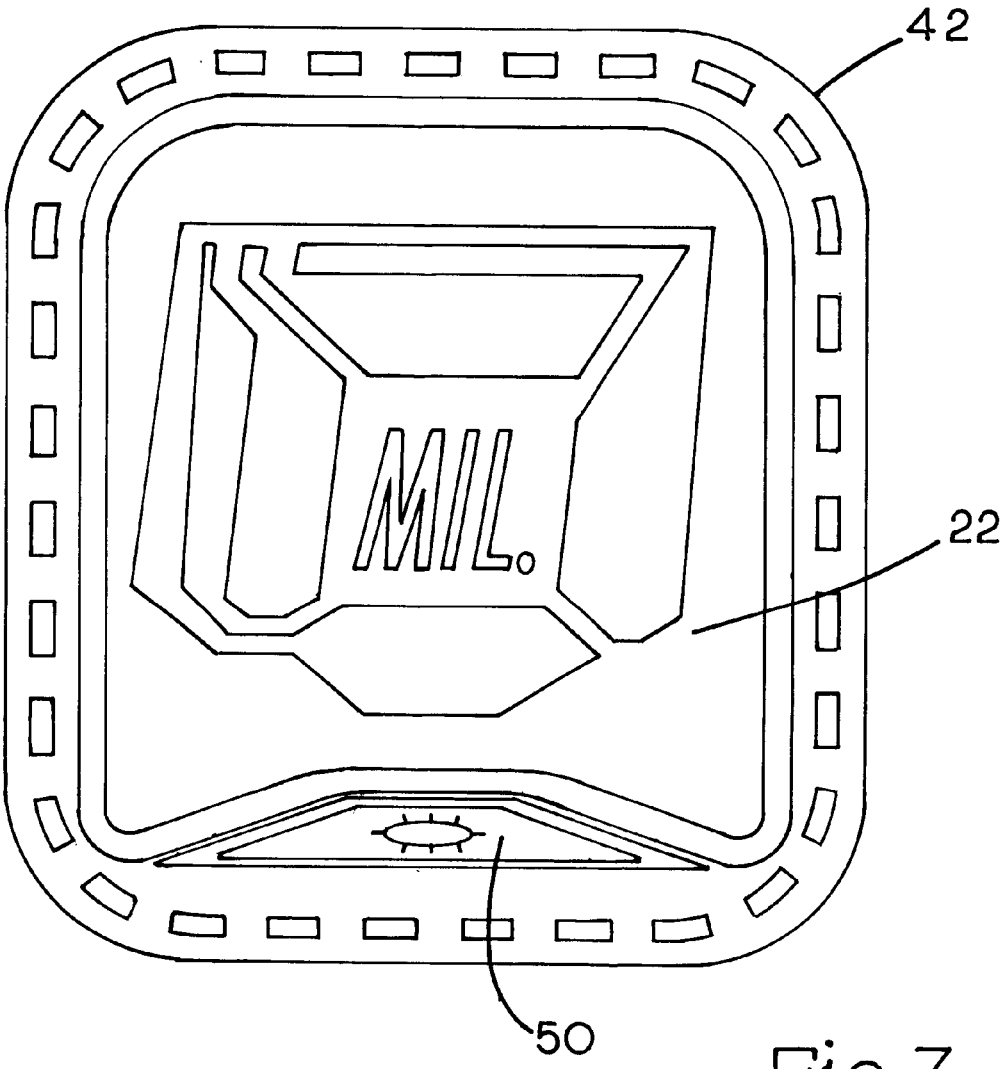
FIG. 3 is a front view showing one embodiment of the active label.

Referring now to FIG. 3, there is shown a front view of an active label constructed in accordance with the present invention. The label 10 shown in FIG. 3 has a generally square configuration. This embodiment uses only a single screen image for displaying a company logo and product information. An illumination button 50 is disposed along the bottom of the display panel 22 to provide a means to turn the backlighting on and off.

Figure 4C:
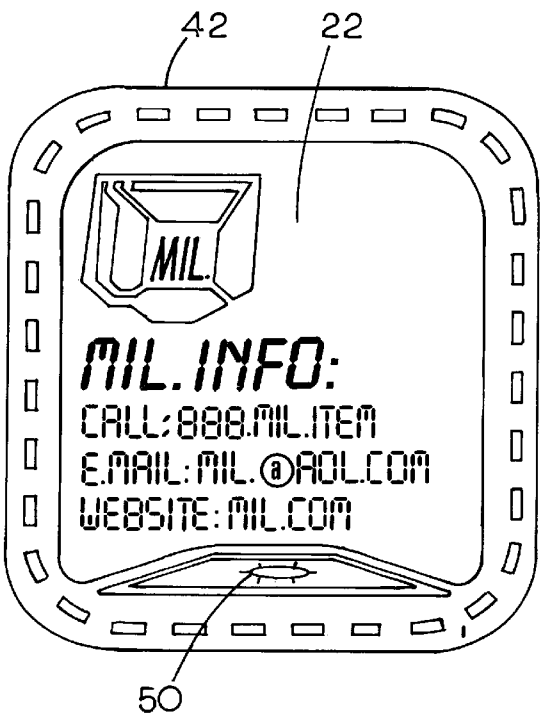
FIGS. 4*a*–4*c* are front elevation views of an active label having multiple display screens.
Figure 4B:
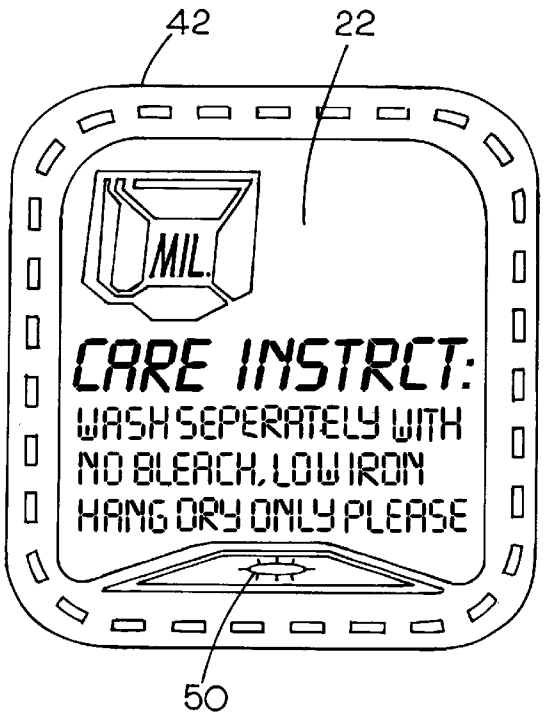
Figure 4A:
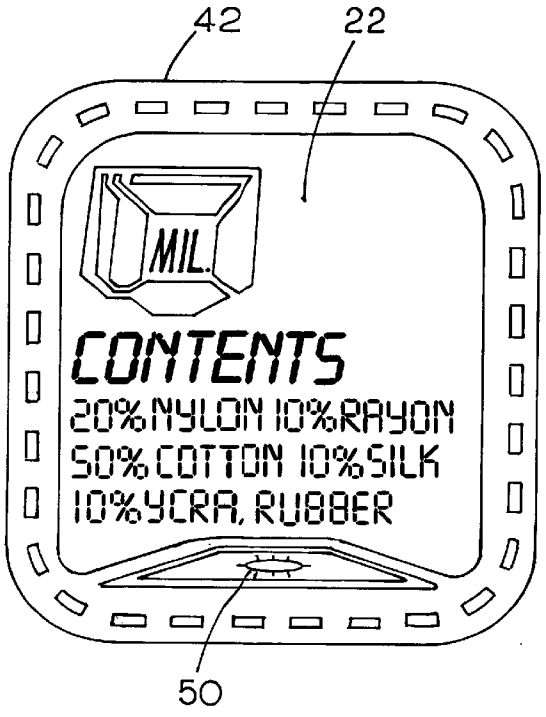

FIG. 4 shows another embodiment of the active label 10 which includes multiple screen images and a button 50. The company's logo is displayed in the upper left corner of each of the display screens. The bottom half of the display 20 is used to display information such as the material content of the garment, care instructions, manufacturer information, e-mail address, telephone numbers, or other information which the manufacturer wants to include on the label. A button 50 is disposed along the bottom of the display to advance the screen image and to turn the backlighting on and off. The button 50 is preferably a two-way toggle button. Pressing the left side of the toggle button 50 advances the screen image. Pressing the right side turns the backlighting on and off.

Figure 5:
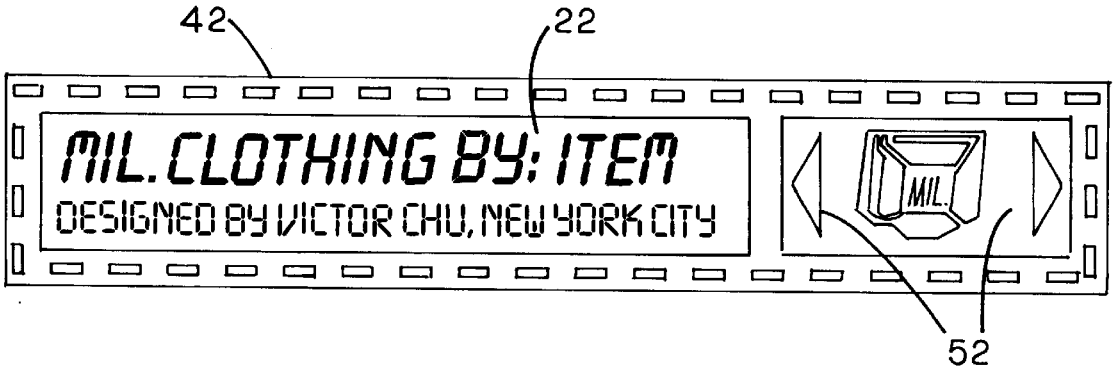
FIG. 5 is a front elevation view of another active label including a touch-sensitive input.

FIG. 5 shows a third embodiment of the active label 10. In this embodiment, the display has an elongated, rectangular shape. The larger area on the left is an information screen on which the label information is displayed. The smaller area on the right where the company logo is displayed is a touch screen 52. The touch screen 52 includes two touch sensitive areas indicated by the triangular pointers. The left pointer advances the display screen. The right pointer turns the backlighting on and off.

Figure 6:
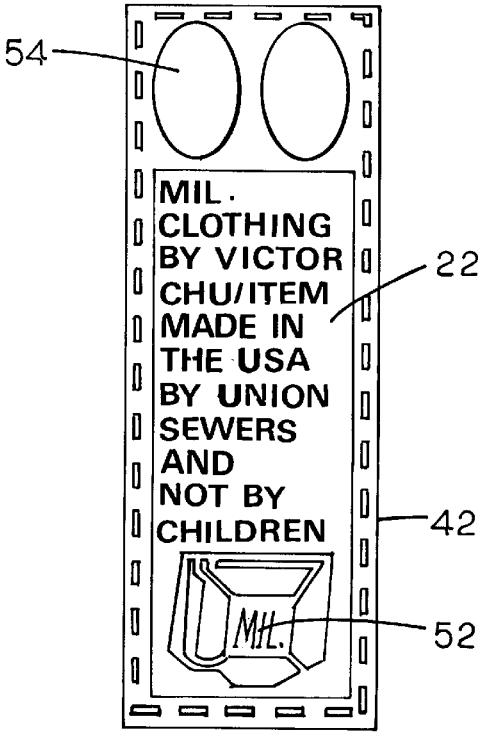
FIG. 6 is a front elevation view of an active label including a solar cell and touch-sensitive input.
Figure 7:
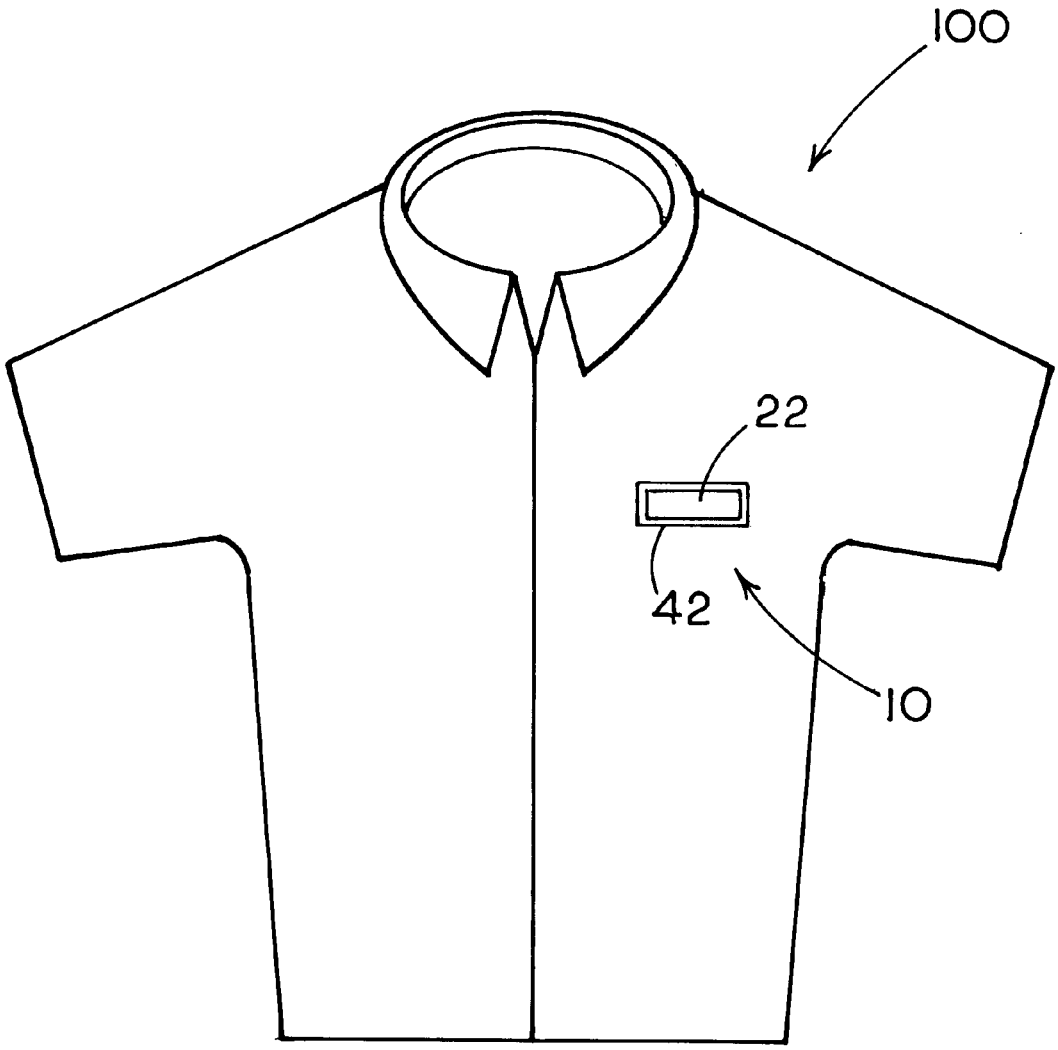
FIG. 7 is a front elevation of a shirt with an active label attached thereto.

FIG. 6 shows a fourth embodiment of the active label 10. In this embodiment, the label has a vertically oriented, rectangular configuration. The upper portion of the rectangle contains one or more solar cells 54 which can be used to power the display and/or recharge the display batteries. The lower portion of the label where the company logo is displayed is a touch screen 52. The middle portion of the label is an information screen. As in the previous embodiment, the touch screen can be used to advance the screen image and to turn the backlighting on and off.

In all of the embodiments described thus far, the label is designed to be sewn onto the garment. The precise location of the label will depend on the type of garment. In shirts, the label would typically be attached to the top edge of a shirt pocket or to the chest area. In pants, the label would typically be attached to a pocket or along the waistline.

Other methods of attaching the label 10 to the garment may also be used. For example, the label 10 may be secured by hooks, buckles, snaps, VELCRO-type fasteners, adhesives, or pins. The label 10 could also be designed as a cartridge which slides in a pocket on the garment. Any attachment technique known in the garment industry could be used.

The present invention overcomes the problems associated with conventional woven or printed labels. Since the label can be programmed to display multiple screen images, only a single label is needed. Thus, the present invention provides a method to convey more information to consumers without cluttering the garment with labels. Also, the label can be easily programmed to automatically display a sequence of related images to provide an animated logo rather than a static logo.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A label for a garment comprising:

a) a base adapted to be affixed to a garment;

b) an electronic display panel affixed to said base; and c) a programmable circuit operatively connected to said display panel, said programmable circuit being programmed to output label information to said display panel for display thereon.

2. The label according to claim 1 wherein said display panel is a liquid crystal display.

3. The label according to claim 2 wherein said liquid crystal display includes a backlight.

4. The label according to claim 3 further including a power switch to alternately turn the power to said backlight on and off.

5. The label according to claim 2 further including a plurality of screen images associated with said display panel which can be selectively displayed on the display panel by the user.

6. The label according to claim 5 further including an input device to manually change the screen image.

7. The label according to claim 5 wherein said screen images include a logo screen.

8. The label according to claim 5 wherein said screen images include at least one product information screen.

9. A method for labeling a garment comprising:

a) providing an electronic display;

b) programming said display to display label information; and c) attaching said display to a garment.

10. The method according to claim 9 wherein the electronic display is a liquid crystal display.

11. The method according to claim 9 wherein the step of programming said display comprises programming the display to display multiple screen images.

12. The method according to claim 11 wherein the electronic display includes an input device to manually change said screen images.

13. The method according to claim 11 wherein said screen images change automatically without input from the user.

14. The method according to claim 12 wherein said input device comprises a pressure-activated button on said display.

15. The method according to claim 12 wherein said input device comprises a touch screen.

16. An improved article of clothing comprising:

a) a body covering garment; and b) a programmable label including an electronic display attached to said garment, wherein said programmable label is programmed to display label information.

17. The clothing article of claim 16 wherein said display is a liquid crystal display.

18. The clothing article of claim 17 wherein said label is programmed to display multiple screen images on said display.

19. The clothing article of claim 18 wherein said label further includes an input device to allow the user to manually change the screen image on said display.

20. The clothing article of claim 19 wherein said input device is a pressure-activated button.

21. The clothing article of claim 19 wherein said input device is a touch screen.

* * * * *

UNITED STATES PATENT AND TRADEMARK OFFICE

CERTIFICATE OF CORRECTION

PATENT NO. : 6,279,170 B1
DATED : August 28, 2001
INVENTOR(S) : Victor Chu

It is certified that error appears in the above-identified patent and that said Letters Patent is hereby corrected as shown below:

Column 4,
Line 29, change “information to” to -- information about the garment to --.
Line 50, change “information;” to -- information about the garment; --.
Line 52, change “to a garment” to -- to the garment --.

Column 5,
Line 5, change “information.” to -- information about the garment. --.

Signed and Sealed this

Thirtieth Day of March, 2004

JON W. DUDAS
*Acting Director of the United States Patent and Trademark Office*